United States Patent [19]

Weaver

[11] Patent Number: 4,484,609

[45] Date of Patent: Nov. 27, 1984

[54] WEDGE DIE FOR PRODUCING BENT PLYWOOD

[75] Inventor: Henry J. Weaver, York, Pa.

[73] Assignee: Simmons Universal Corporation, New York, N.Y.

[21] Appl. No.: 476,899

[22] Filed: Mar. 18, 1983

[51] Int. Cl.[3] ..... B27H 1/00

[52] U.S. Cl. ..... 144/256.1; 100/211; 156/583.6; 156/583.8

[58] Field of Search ..... 144/254, 256.1, 256.3, 144/256.4, 259, 381; 100/211; 156/580, 583.1, 583.6, 583.8, 583.9

[56] References Cited

U.S. PATENT DOCUMENTS 2,149,507 3/1939 Camfield ..... 144/256.3

3,063,483 11/1962 Shumacher ..... 144/254 X

FOREIGN PATENT DOCUMENTS 535819 11/1955 Italy ..... 144/256.3

*Primary Examiner*—W. D. Bray

[57] ABSTRACT

A wedge die is provided for shaping plywood or the like into a desired configuration. It includes a female die section having a body member with a channel defined therein. The channel has opposing inwardly tapered walls and an inner surface connecting these walls. First and second generally L-shaped slidable members are held by spring members and connecting links within the channel and in contact with the tapered walls. The slidable members have opposing inner surfaces which correspond to the desired exterior surface of the workpiece. A compressible bumper is positioned between the inner surface of the channel and each of the slidable members. A male die member having an exterior surface corresponding to the desired interior surface of the workpiece is also provided. In operation, the female die section is forced upon the male die member. After the male die member is a certain distance within the channel, the slidable members move towards the inner surface of the channel and accordingly toward each other. Vertical and horizontal pressure is thereby applied to the workpiece.

13 Claims, 4 Drawing Figures

WEDGE DIE FOR PRODUCING BENT PLYWOOD

BACKGROUND OF THE INVENTION

1. Field of the Invention.

The field of the invention relates to an apparatus for bending material such as laminated wood veneers.

2. Brief Description of the Prior Art.

The manufacture of certain furniture designs requires the bending of plywood into a desired shape. An apparatus known as a wedge die has been employed for this bending. A previous such wedge die has included a female section and a male section. The male section is split in two with the halves separated by about a one inch space. A plurality of fire hoses are flattened and positioned within this space. The hoses are capped with an air inlet on one end. A manifold is provided for tying all the hoses together so that only a single air supply is required.

As the female section is forced down over the male section, a workpiece positioned therebetween is bent into a generally U-shaped configuration having about the same shape as the female cavity. After the die sections are closed to their limit, compressed air expands the fire hoses applying additional pressure to the workpiece.

This type of forming die has several drawbacks. One is limitation of side pressure which is controlled largely by the air supply. There are also pressure limits to the caps and connections to the hoses. The split male section must also be of sufficient size to provide structural integrity. This limits the minimum size "U" configuration that can be formed.

SUMMARY OF THE INVENTION

A wedge die is provided for forming plywood or the like into a desired configuration. The die includes a female die structure comprising three members and a male structure comprising a single member. Means are provided for holding the three female members together.

One female body member may be of generally U-shaped construction, the configuration of which defines a channel having inwardly tapered walls. The other two female members may each have a generally L-shaped configuration. They are positioned within the channel of the U-shaped member so as to form a generally U-shaped female structure. The male member is adapted to fit within a channel defined by the surfaces of the L-shaped members. Its outer surface corresponds to the desired internal surface of the workpiece. The inner surfaces of the L-shaped members correspond to the desired external surface of the workpiece.

The L-shaped members preferably define a wedge-shaped channel. Means are provided for at least initially spacing them from the surface of the U-shaped member defining the deepest part of the channel. When forced further into the channel, the L-shaped members will move toward each other as they slide along the tapered channel walls. Horizontal pressure may thereby be exerted upon a workpiece.

The female structure may be forced upon the male structure by means of a hydraulic pressure apparatus. The workpiece will accordingly be formed into a desired configuration.

DETAILED DESCRIPTION OF THE INVENTION

Figure 1:
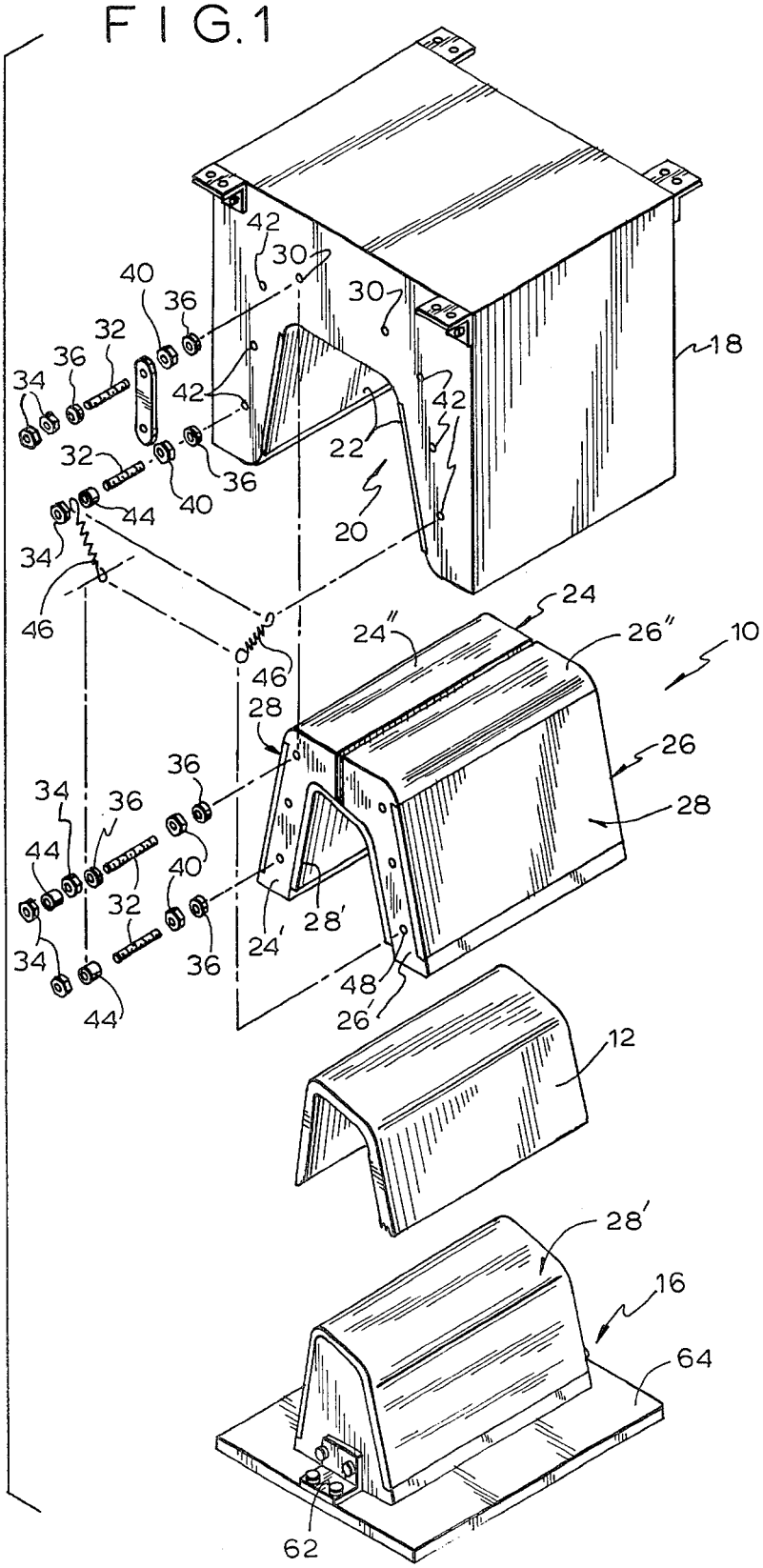
FIG. 1 is an exploded perspective view illustrating a wedge die according to the invention and a finished workpiece.

A wedge die 10 for shaping a workpiece 12 consisting of glued veneers or the like is provided. The die 10 includes a generally U-shaped female die 14 and a male die member 16.

The female die 14 includes a generally U-shaped member 18 which defines a longitudinal channel 20. The channel walls include a quarter-inch thick canvas reinforced synthetic resin sheet 22 to reduce friction. A pair of generally L-shaped members 24,26 are positioned within the channel 20 in opposing relation to each other. These members each include relatively long leg portions 24',26' and inwardly projecting flange portions 24'',26''. The exterior surfaces of the leg portions 24',26' are each provided with a one-quarter inch thick canvas reinforced synthetic resin sheet 28 to reduce friction. The surface of the male die member 16 includes a one-sixteenth inch aluminum sheet 28' mounted thereto. This sheet serves as an R.F. electrode to provide power for R.F. curing of the plywood workpiece. A similar sheet 28' is placed along the inner surfaces of members 24,26 so that the workpiece 12 will be sandwiched between a pair of metal sheets when the die is in operation. The exterior surfaces of the L-shaped members 24,26 correspond to the surfaces defining the channel 20.

Member 18 is provided with a pair of holes 30 located above the channel 20. Each hole 30 is provided with a rod 32 extending therethrough. A pair of jam nuts 34, a flat washer 36, a connecting link 38, a full nut 40, and another flat washer 36, respectively, are mounted at each end of the rods.

A set of six holes 42 extends through member 18 and has openings in the end faces thereof. Each hole has a rod 32 positioned therein and a jam nut 34, spacer 44, full nut 40, and flat washer 36, respectively, mounted thereto at each end. A spring 46 is also mounted to each of the ends of the six respective rods 32.

Each of the L-shaped members 24,26 is provided with a set of three colinear holes 48 in the longer leg portions 24', 26' thereof. The upper holes of each member 24,26 each include a rod 32 extending therethrough. The ends of these rods 32 each include a jam nut 34, spacer 44, jam nut 34, flat washer 36, connecting link 38, full nut 40 and flat washer 36, respectively mounted thereto.

The remaining two holes of each L-shaped member include rods 32 positioned therein. A jam nut 34, spacer 44, full nut 40, and flat washer, respectively, are mounted to the ends of each rods.

A set of four connecting links 38 extending between holes 30 and the upper holes 48 hold members 24 and 26 within the U-shaped member 18. Each link 38 includes a circular hole at one end through which the rods 32 in holes 30 pass. The opposite ends of the links include elongate slots for receiving the rods from holes 48. The slots allow the L-shaped members 24,26 to move towards or away from the surface 50 defining the deepest portion of channel 20.

The diagonally mounted springs 46 extending between the rods 32 in holes 42 and 48 retain the L-shaped members 24,26 against the tapered side walls of channel 20. A pair of rubber bumpers 52 separate the top walls of these members 24,26 from surface 50 of member 18.

A plurality of mounting brackets 54 are provided for mounting the female die 14 to a movable top platen 56 of a hydraulic press. The press controls the vertical position thereof.

The female die 14 is reinforced against internal pressure by four pre-stressed angle assemblies 58 that are tied across the width of the die by tension bars 60. The U-shaped member 18 may be constructed from a plurality of wood veneers running in the direction of the width. The L-shaped members 24,26 may be of similar construction. The male member 16 is of solid one-piece construction and has an exterior surface which conforms to the desired internal configuration of the workpiece 12. A pair of mounting brackets 62 secure the male member to a stationery bottom platen 64. This arrangement distributes the pressure over a wider area and provides stability in storage.

Figure 2:
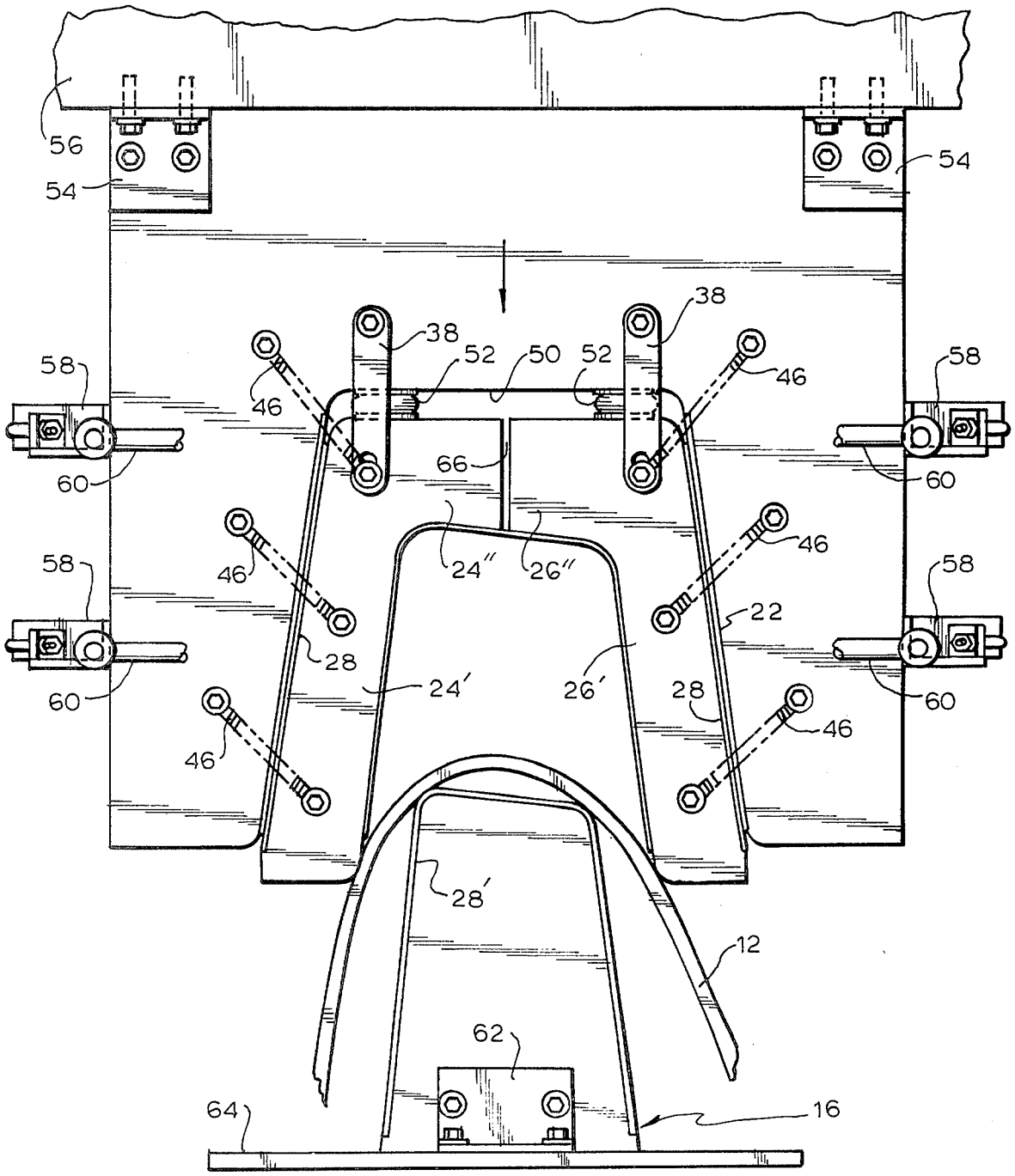
FIGS. 2–4 are front elevation views which sequentially illustrate the wedge die in operation.
Figure 3:
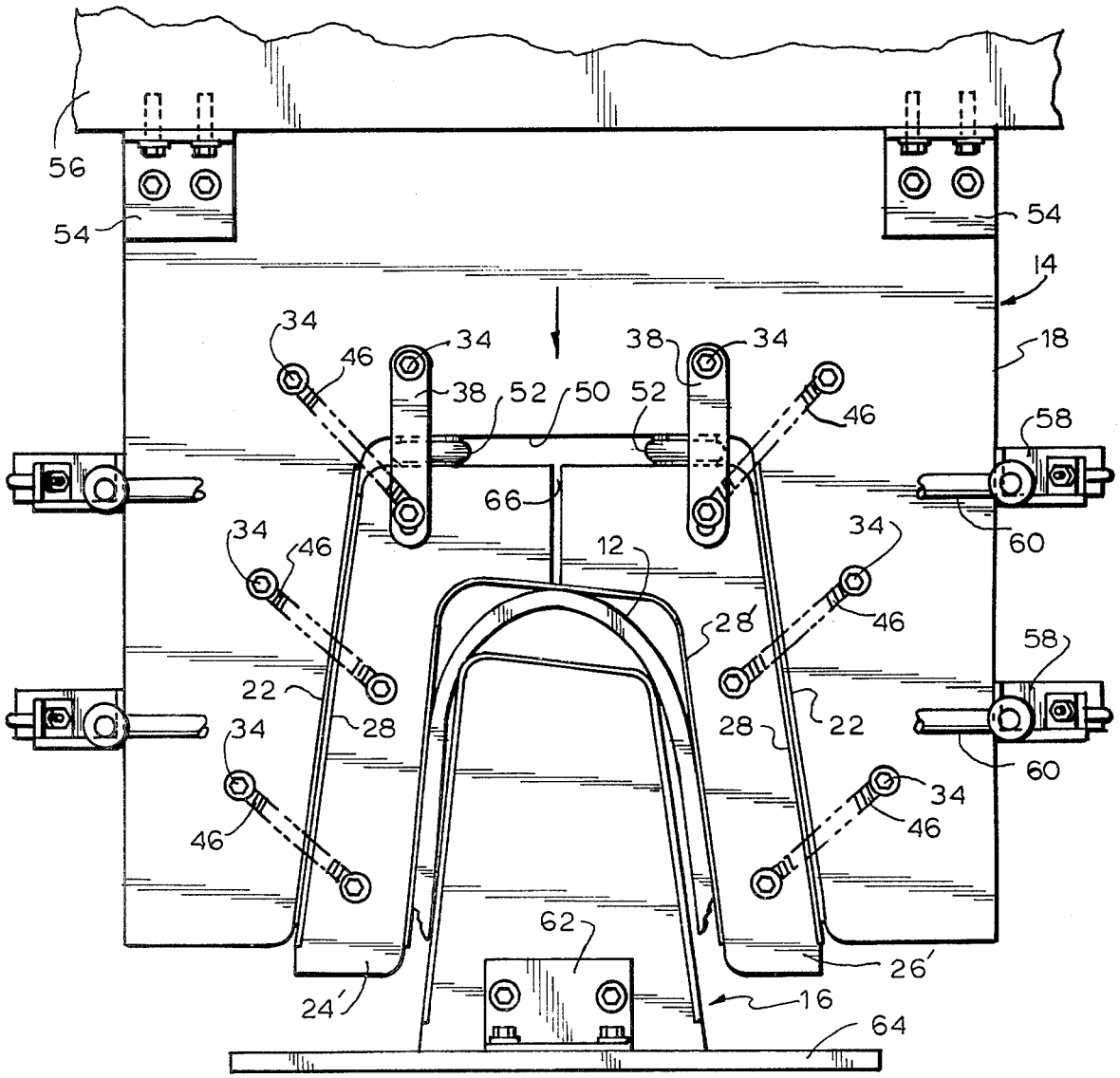
Figure 4:
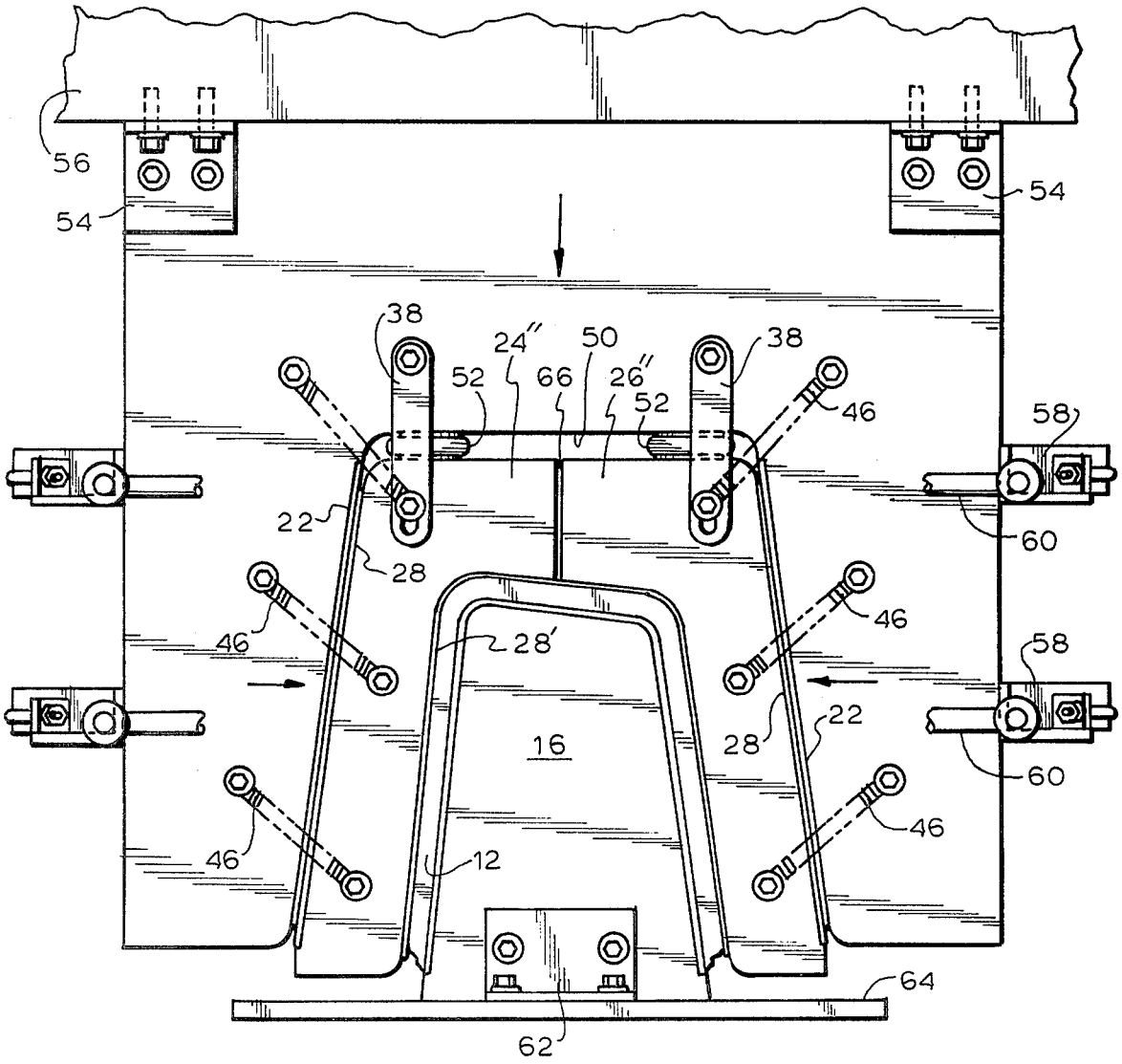

Referring to FIGS. 2–4, the operation of the wedge die 10 will be described. With the male 16 and female 14 sections fully open, a workpiece 12 comprising glued veneers is properly positioned on the male member 16 and under the female die 14. Hydraulic pressure is exerted on the female die 14 forcing it down upon the male member with the glued veneers therebetween. The die 14 continues to a nearly closed position (beyond the stage shown in FIG. 3) at which point the force exerted equals the resistance of the rubber bumpers 52. The bumpers act as compression springs to limit the vertical motion of members 24,26 with respect to surface 50. Once the force exerted by the hydraulic press exceeds the resistance thereof, the bumpers compress allowing members 24,26 to slide along the tapered walls of channel 20. The resulting inward movement of these members 24,26 causes the exertion of side (horizontal) pressure on the die surface equal to or greater than the vertical pressure exerted. This side pressure can be controlled by the angle of the tapered channel walls. FIG. 4 illustrates this stage and shows the space 66 between members 24 and 26 to be visibly smaller than that shown in FIGS. 2 or 3.

When the female die 14 is retracted, the bumpers 52 are relaxed to their initial dimensions. Side pressure on the male die member 16 is accordingly relieved allowing its withdrawal with no frictional side interference. When fully retracted, the completed workpiece 12 as shown in FIG. 1 may be removed from the male die member 14 making it ready to receive a new veneer lay-up.

What is claimed is:

1. A wedge die for shaping a workpiece into a desired configuration, comprising:

a female die including a body member having a channel defined therein, said channel having inwardly tapered opposing side walls, and first and second slidable members positioned in opposing relation within said channel and having respective external surfaces in slidable contact with one of said opposing side walls and opposing internal surfaces, a male die member insertable within said channel; and means for causing said first and second slidable members to slide along said tapered walls, thereby moving towards said male die member and each other, when said male die member has been inserted a certain distance into said channel.

2. A wedge die as defined in claim 1 including means for moving said female die towards said male die member.

3. A wedge die as defined in claim 1 wherein each of said first end second slidable members includes an inwardly projecting flange portion.

4. A wedge die as defined in claim 3 wherein said channel includes an inner surface connecting said tapered opposing side walls, and at least one resilient member positioned between said inner surface and said inwardly projecting flange portions.

5. A wedge die as defined in claim 4 wherein said resilient member is a compressible bumper.

6. A wedge die as defined in claim 3 including a first connecting link connecting said body member and said first slidable member and a second connecting link connecting said body member and said second slidable member.

7. A wedge die as defined in claim 6 including first spring means connecting said body member and said first slidable member and urging the latter into contact with one of said opposing side walls, and second spring means connecting said body member and said second slidable member and urging the latter into contact with the other of said opposing side walls.

8. A wedge die as defined in claim 1 wherein each of said first and second slidable members has a metal layer defining its external surface.

9. A wedge die as defined in claim 3 wherein each of said first and second slidable members has a generally L-shaped configuration.

10. A wedge die as defined in claim 1 wherein said male die member has an external surface corresponding to the configuration of said opposing internal surfaces of said first and second slidable members.

11. A wedge die as defined in claim 1 wherein each of said first and second slidable members includes a side portion and an inwardly projecting top portion, said top portions being in opposing relation and defining a space therebetween; said body member including an inner channel surface connecting said tapered opposing side walls; and a resiliently compressible member positioned between each of said top portions and said inner channel surface.

12. A wedge die as defined in claim 11 including first spring means connecting said body member and said first slidable member and urging the latter into contact with one of said opposing side walls, and second spring means connecting said body member and said second slidable member and urging the latter into contact with the other of said opposing side walls.

13. A wedge die as defined in claim 12 including a first rigid connecting link connecting said body member and said first slidable member and a second rigid connecting link connecting said body member and said second slidable member.

* * * * *